US005190311A

United States Patent [19]

Carpenter et al.

[11] Patent Number: 5,190,311

[45] Date of Patent: Mar. 2, 1993

[54] SNOWBOARD BINDING SYSTEM

[75] Inventors: Jake Carpenter, East Dorset; David J. Dodge, Charlott, both of Vt.

[73] Assignee: Burton Snowboards U.S.A

[21] Appl. No.: 758,530

[22] Filed: Sep. 6, 1991

Related U.S. Application Data

[63] Continuation of Ser. No. 478,586, Feb. 9, 1990, abandoned.

[51] Int. Cl.[5] ..... A63C 9/086

[52] U.S. Cl. ..... 280/618; 280/14.2; 280/607

[58] Field of Search ..... 280/607, 11.14, 618, 280/617, 619, 620, 621, 14.2

[56] References Cited

U.S. PATENT DOCUMENTS

| | | | |
|---|---|---|---|
| 3,900,204 | 8/1975 | Weber | 280/607 |
| 4,079,962 | 3/1978 | Frechin | 280/613 |
| 4,403,785 | 9/1983 | Hottel | 280/607 |
| 4,652,007 | 3/1987 | Dennis | 280/14.2 |
| 4,955,632 | 9/1990 | Prestipino Giarritta et al. | 280/607 |

FOREIGN PATENT DOCUMENTS

| | | | |
|---|---|---|---|
| 350411 | 1/1990 | European Pat. Off. | 280/14.2 |
| 2630922 | 11/1989 | France | 280/14.2 |
| 8903711 | 5/1989 | World Int. Prop. O. | 280/607 |

*Primary Examiner*—Eric D. Culbreth

[57] ABSTRACT

A snowboard binding system is disclosed which uses a pair of cables extending from spaced points on a first forward boot plate to corresponding spaced points on a second rearward boot plate, with each cable passing through independent tensioning means for preventing movement of the boot plates under normal loads occurring as a snowboarder is maneuvering. When an abnormal load is encountered by one boot plate, the retaining force applied by the tensioning means is overcome and both boot plates are conditionally releasable, but not separated from the snowboard. The cable binding system also allows automatic return of the plates to the snowboard where they are held against movement when the abnormal load is reduced to a normal level.

22 Claims, 3 Drawing Sheets

SNOWBOARD BINDING SYSTEM

This is a continuation of U.S. Pat. application Ser. No. 478,586, filed Feb. 9, 1990 now abandoned.

TECHNICAL FIELD

This invention relates to snowboards and, more particularly, to binding systems for use on snowboards.

BACKGROUND OF THE INVENTION

A snowboard is essentially a single wide ski provided with one or more platforms for supporting both feet of a skier. These snowboards can be of various configurations, as exemplified by U.S. Pat. Nos. 3,900,204 and 4,403,785. Typically, a snowboard includes fore and aft fixed boot bindings, which allow the skier to place one of his feet at an angle with respect to the longitudinal axis of the board, as opposed to the axial boot alignment of conventional skis. The snowboarder's stance is dictated by the need to maintain balance. Typically, both the ankles and knees flex during snowboarding to allow weight shifting to adjust for changing conditions, such as when making turns or when attempting to slow down. Consequently, conventional ski bindings, which rigidly maintain a boot parallel to the ski longitudinal axis are not considered acceptable for use on snowboards.

In U.S. Pat. No. 4,652,007, a releasable binding system is disclosed for use on a snowboard. The system uses releasable toe and heel binding clips secured to the snowboard with a mounting plate placed on the toe and heel clips along a longitudinal axis of the snowboard. These clips are adapted from conventional ski bindings. Each mounting plate has a pair of laterally extending portions, extending parallel to the rider's feet and means for securing a boot to the plate. The rearwardly located mounting plate is placed normal to the snowboard and the forwardly located mounting plate is secured at a predetermined angle relative to the longitudinal axis of the snowboard. The toe and heel clips release the boot and mounting plate in a manner similar to conventional ski bindings. However, since the toe and heel clips are placed along the longitudinal axis of the snowboard, forces acting other than normal to the snowboard and the rider may not cause release to occur. Also, these are total release bindings, with no provision for absorbing forces and for automatic resetting of the mounting plate once the upsetting force has subsided. Similar to conventional ski bindings, once release occurs, the rider is released from the snowboard.

In U.S. Pat. No. 4,079,962, a releasable ski binding is disclosed using a sole plate and a flexible cable housed in the sole plate, extending from opposite ends thereof. The ends of the cable are secured to the ski, with one end of the cable fixed securely to the ski by a plate and the other end secured to a turning element supported on a shaft held on the ski. The front part of the sole plate has a complementary profile which cooperates with the edge of a cable engaging element, to hold the plate on the ski in a longitudinal direction parallel to the longitudinal axis of the ski. The binding uses a pair of cable engaging elements spaced apart from each other, the elements being movable closer to each other to lengthen the cable to provide a partial release of the sole plate from the ski. The elements are biased to force them away from each other with the breakaway force being sufficient to overcome the biasing and thus allow lengthening of the cable. However, such a binding system again is dependent on the application of a predetermined force acting in a particular direction to cause lifting of the sole plate and release from the ski. Also, the sole plate breaks away from the ski.

While usable for conventional skis, such a binding system is not readily adaptable to snowboard bindings which must accommodate changes in the user's weight distribution which varies over a range of angles relative to the snowboard and absorb the dynamic forces encountered during snowboarding.

OBJECTS OF THE INVENTION

It is an object of the present invention to provide a snowboard binding system which is conditionally releasable from a stable state under varying loads i.e., becomes compliant after a predetermined load force has been reached, but the binding does not separate from the board.

It is a further object to provide a snowboard binding system which accommodates the dynamic variations in forces during snowboarding.

It is a further object to provide a snowboard binding system which is of simple construction and lightweight.

It is yet another object of the present invention to provide a snowboard binding system which varies the boot plate retaining effort such that after an adjustable amount of force is applied to one boot plate, the retaining effort drops quickly to the other boot plate to allow rapid separation of both boot plates from the snowboard.

It is yet another object to provide a snowboard binding system which provides a substantial release action relative to forces applied in a full 360 degree direction.

It is yet another object to provide a snowboard binding system which provides automatic return of the boot plate to the snowboard when the force that produces a release from a stable condition is relieved.

An additional object is to provide a snowboard binding system having release mechanisms placed normal to the foot, rather than parallel to the longitudinal axis of the snowboard.

BRIEF DESCRIPTION OF THE INVENTION

According to the present invention, a snowboard binding system is disclosed having a first boot attachment means, a second boot attachment means, each boot attachment means releasably disposed on a snowboard from a stable condition to a compliant condition. The binding system has release means preferably comprising a pair of flexible cable means, one cable means connecting the forward portions of the front and rear boot attachment means and the other cable means connecting the rearward portions of the boot attachment means. Tension means are provided which act separably on each of the pair of cable means, for biasing each cable means into a retracted condition, the biasing adjustably resisting loads sufficient to cause the cable to extend each cable means being independently variable in response to increasing load conditions, such that during normal loads above a selectable upset load force each cable fixedly retains each respective boot attachment means to the snowboard, and such that during abnormal loads, applied to either boot attachment means, both of the boot attachment means are releasable from the fixed condition on the snowboard into a compliant condition.

DETAILED DESCRIPTION OF THE INVENTION

Figure 1:
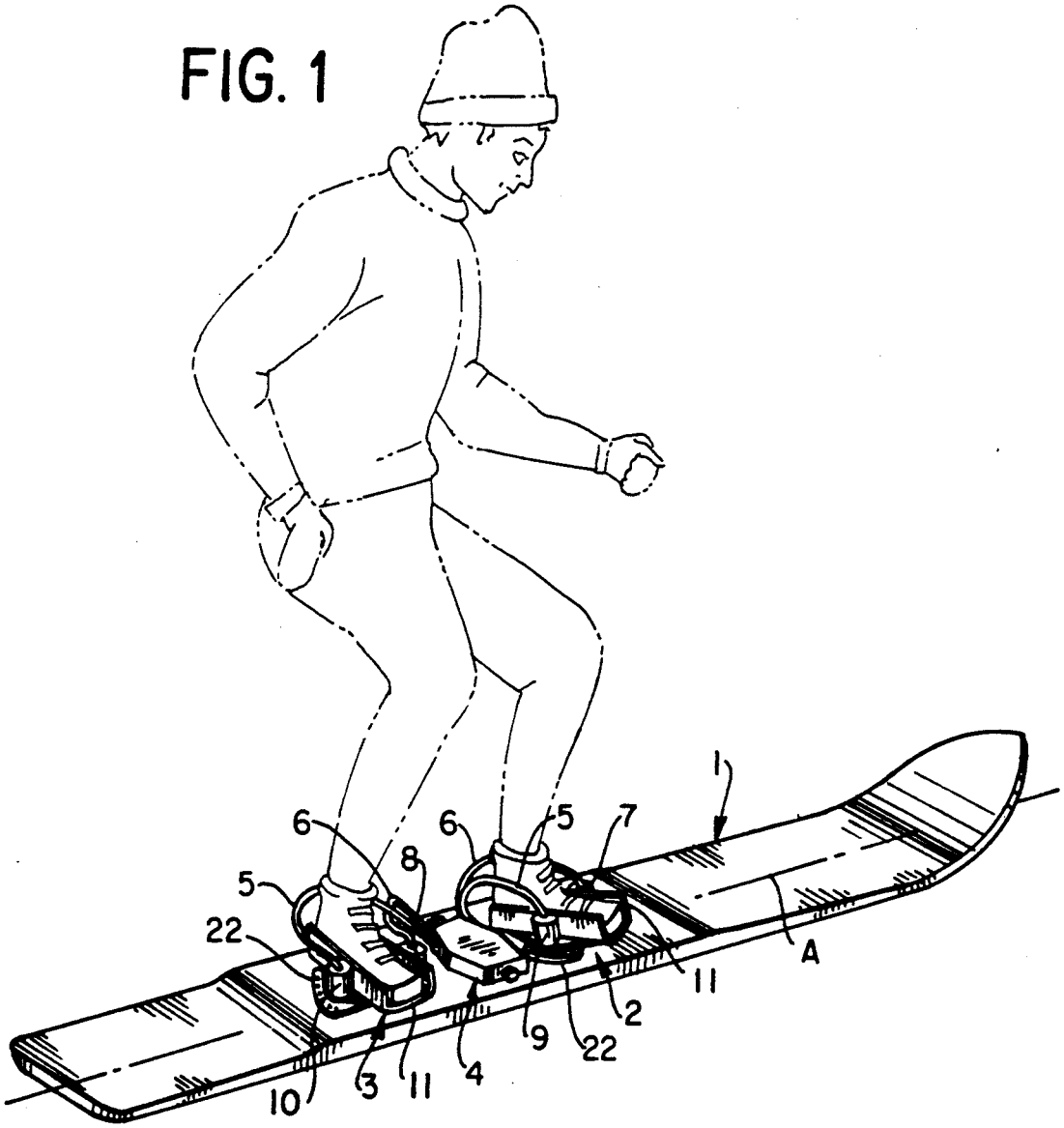
FIG. 1 is a perspective view of a snowboard including the snowboard binding system of the present invention.

Referring to FIG. 1, a snowboard 1 of conventional shape includes a first boot plate assembly 2, a second boot plate assembly 3, a tensioning apparatus 4 located between the two assemblies and a pair of cables 5 and 6. The plates are typically disposed with the first boot plate assembly placed at an angle relative to a longitudinal axis A, with the second boot attachment means placed normal to the axis. The first and second boot plate assemblies are interconnected by the cable 5, connecting the points 7 and 8, on one side pad of the two boot plates 2, 3 and by the cable 6 connecting the points 9 and 10. Thus, one cable connects the forward other cable 5 connects the rearward portions of both plates. Each cable extends through the tensioning apparatus 4 which is described in detail below.

Figure 2:
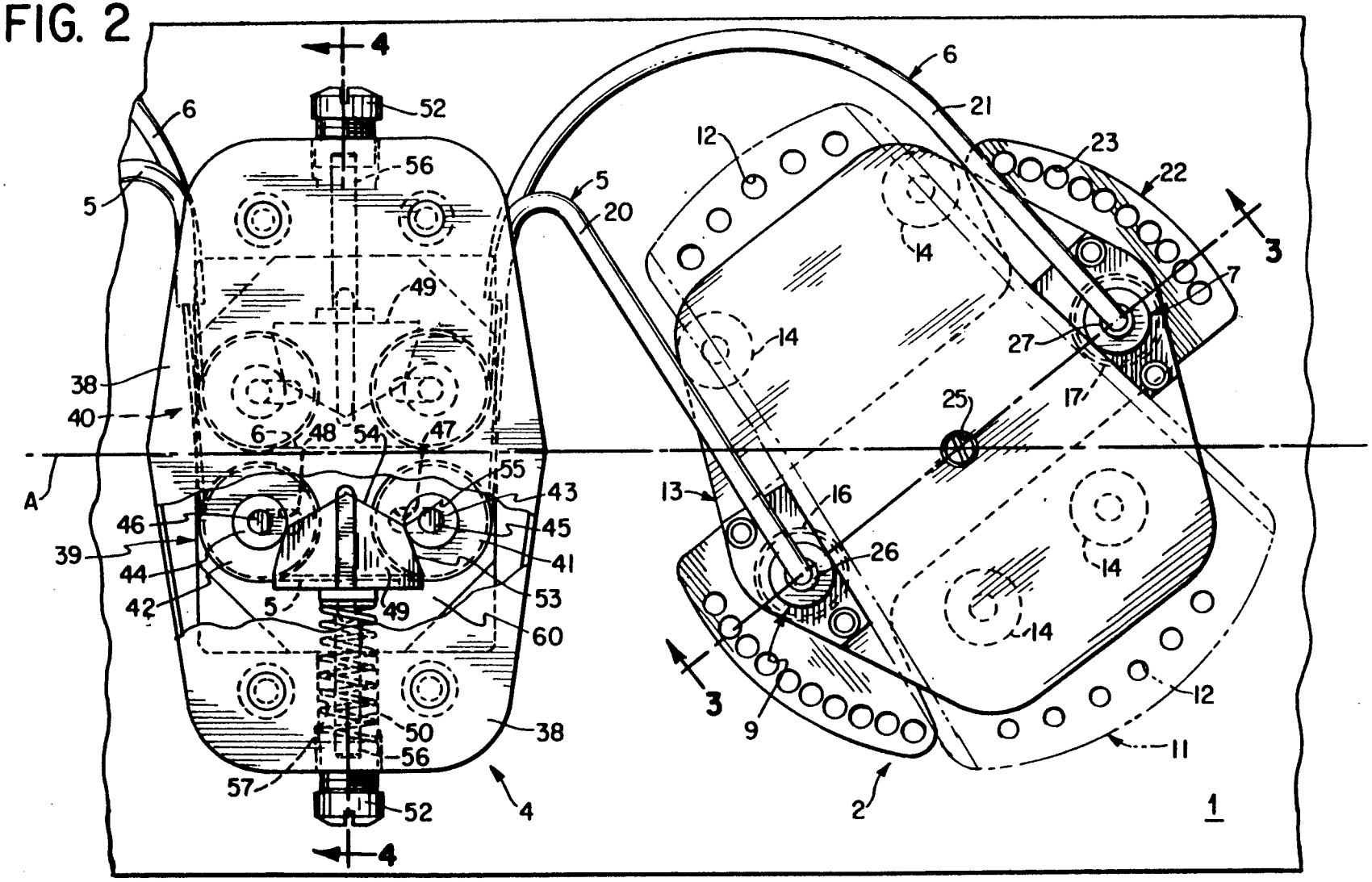
FIG. 2 is an enlarged sectional view of a portion of the snowboard binding system of the present invention.
Figure 3:
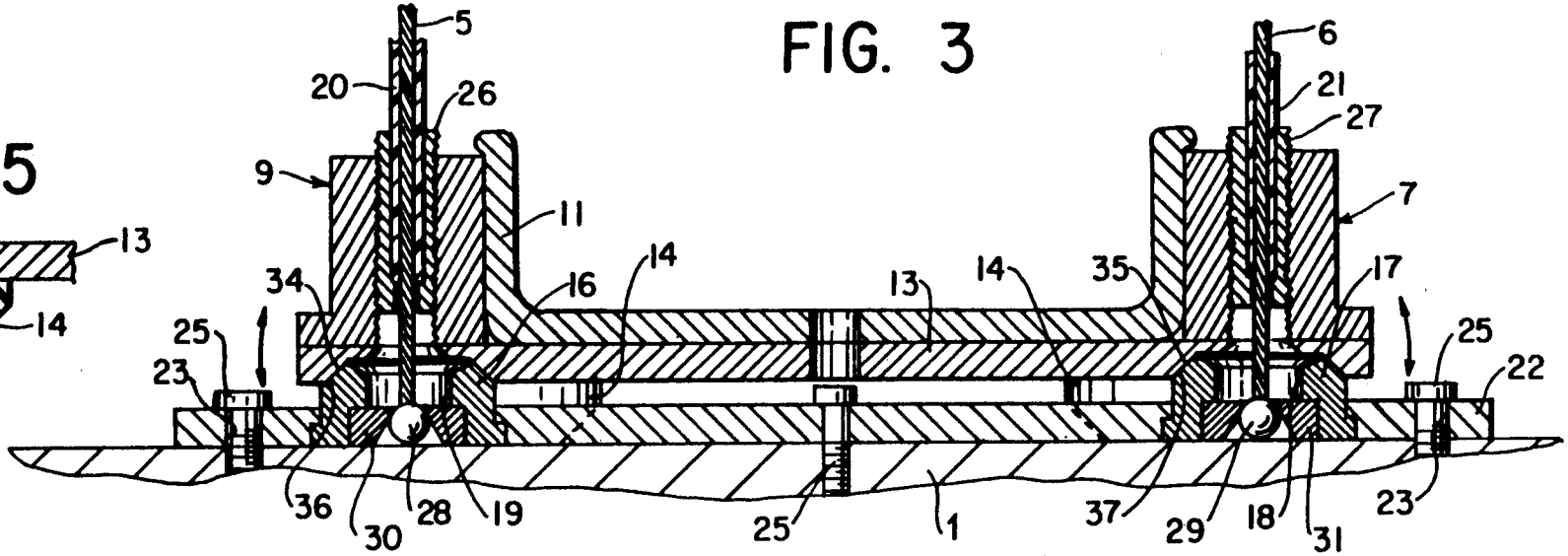
FIG. 3 is a cross sectional view of the boot attachment means of FIG. 2.
Figure 5:
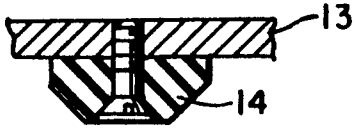
FIG. 5 is an enlarged cross sectional view of a support pad.

Referring to FIG. 2, a plan sectional view of the binding system for assembly 2 is shown and FIG. 3 shows a partial elevational cross-section. The assembly 3 is of the same construction. The boot plate assembly 2 has a boot plate 11 contoured to the shape of a boot and has straps (not shown) for securing a boot thereto. The boot plate 11 is attached to an adaptor plate 13 which is supported by support pads 14 which rest on the snowboard. The support pads 14 are preferably composed of an elastomeric material such as either a hard or soft rubber. The adaptor plate 13 also includes a plurality of mounting holes 15 for attaching the adaptor plate to the boot plate. However, the adaptor plate and boot plate are preferably made as a single unit.

The adaptor plate 13 rests on a pair of conical guide bushings 16 and 17 disposed on an axis transverse to the length of plate 11, and above plate 22. Bushings 16, 17 are preferably made of a resilient material having central passages 18 and 19 which allow a portion of cables 5 and 6 to pass therethrough. Cables 5 and 6 extend through cable sleeves 20 and 21 which are essentially flexible tubes which house and guide the cables.

The base plate 22 is used to attach the assembly 2 to the snowboard 1. A plurality of mounting holes 23 are provided for adjusting the angle of the assembly 2 relative to a longitudinal axis 24 of the snowboard. Typically, a snowboard includes a similar set of mounting holes which are aligned with the mounting holes 23. Thus, the angle of the assembly, relative to the snowboard, is adjustable.

Referring to FIG. 3, the base plate 22 is mounted on the board 1 using fasteners 25. The cables 5 and 6 each extend through a tension adjusting screw 26 and 27, with each cable having a ball end 28 and 29 disposed in cable retaining clips 30 and 31. The clips 30 and 31 reside in the guide bushings 16 and 17, respectively. The guide bushings 16 and 17 have tapered surfaces 34 and 35 which are tapered to correspond to the tapered surfaces 36 and 37 in the adaptor plate 13. The tapered surfaces assist in proper repositioning of the adaptor plate after a release. The support pads 14 are also shown.

While the plate 2 is shown disposed at a particular angle relative to the longitudinal axis 24 of the snowboard, there are no toe or heel plates aligned with the axis to restrain the adaptor plate, and different directional forces can be absorbed by the cable binding system. Also, since the bushings 16, 17 are disposed on the base plate 2, 3 normal to the respective boot plate, regardless of the angle of the assembly, the two cables and their attachment points are always placed normal to the foot length of the, assuring that transverse loads, i.e., across the length of foot, are absorbed by the cables. It should be noted that the term "release" in regard to this invention means temporary spacing of the adaptor plate 13 from a stable resting on the bushings 16, 17 with return once the breakaway force has subsided. Thus, the binding system does not disconnect a rider from the snowboard.

Referring again to FIG. 2, the tensioning apparatus 4 is shown disposed within a housing 38. The apparatus 4 comprises a system for tensioning cables each of 5, 6 such that a cable is in response to a selectable applied force, i.e., the upset force, being exceeded. A tensioning device is required for each cable and thus a pair of tensioning devices are provided. Each tensioning device may include separate adjustment means to vary the tensioning or retaining force (upset force) of each cable or include adjustment means to set the retaining force of both tensioning devices simultaneously.

Referring still to FIG. 2, a first and a second tensioning device 39, 40 are used to tension the cables 5 and 6. Since the tensioning devices are identical, only one will be described in detail. However, it should be noted that there is no requirement that the two tensioning devices be identical and thus one skilled in the art may utilize a different design tensioning device with each cable.

The tensioning device 39 includes a pair of rotatable pulleys 41 and 42, the pulleys disposed in a facing relationship and having cam rollers 43 and 44 coaxial therewith. Both the rollers and pulleys rotate about shafts 45 and 46, respectively. The shafts 45 and 46 are disposed within facing slots 47 and 48, respectively, formed in a frame 60. A cam 49 engages the rollers 43 and 44 with the position of the rollers on the cam determining the spacing between the pulleys 41 and 42. The cam is held in contact with the pulleys by a spring 50 disposed within a cylinder 51 with the degree of spring biasing adjustable in accordance with the depth of screw 52.

The cam 49 includes first and second cam surfaces 53 and 54, respectively, each having a different slope, with the transition point 55 essentially corresponding to the upset force point, after which point rapid release and extension of the cable occurs with a reduced amount of force. Thus, prior to the rollers passing the point 55, the degree of cable extension is minimized, allowing flexing and some movement of the adaptor plates without substantial release. After passing the point 55, a quicker enlargement of the cable is achieved, which reduces the force required to obtain release of both adaptor plates 13 from the stable condition to the compliant condition where the plates are permitted to unseat from and pivot on the bushings.

TABLE 1

| LOAD CHARACTERISTICS: (daN-m) | | | |
|---|---|---|---|
| SETTING | START | MID | END |
| 1 | 0.90 | 1.82 | 2.76 |
| 2 | 2.82 | 2.12 | 3.08 |
| 3 | 4.26 | 2.42 | 3.36 |
| 4 | 5.64 | 2.72 | 3.75 |
| 5 | 7.08 | 3.02 | 4.00 |
| 6 | 8.48 | 3.34 | 4.30 |
| 7 | 9.90 | 3.64 | 4.62 |
| 8 | 11.30 | 3.94 | 4.92 |

Figure 4:
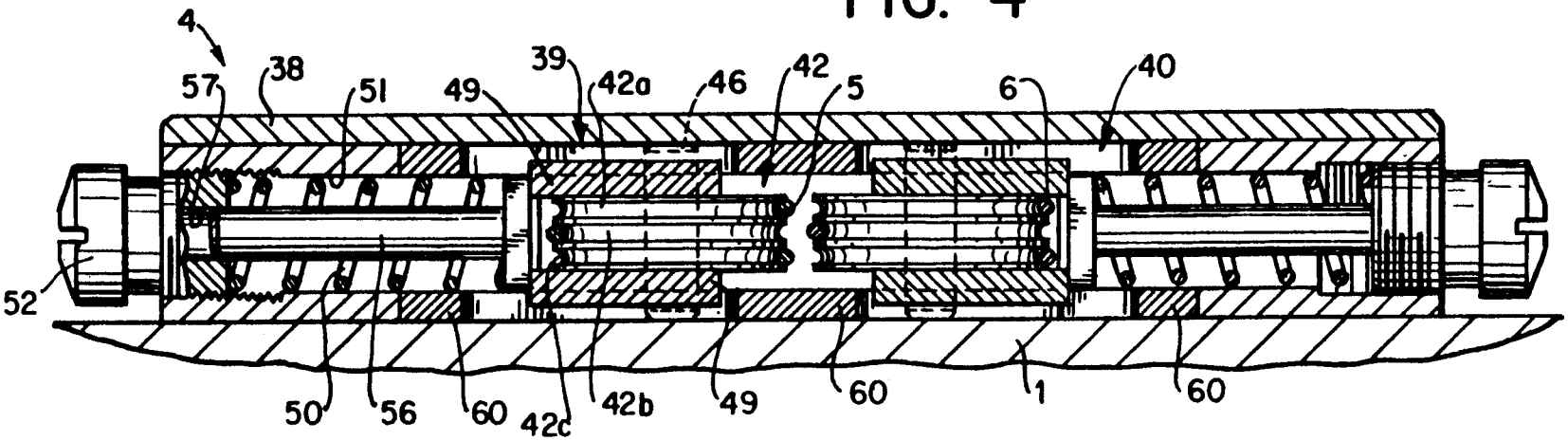
FIG. 4 is a cross sectional view of the tensioning apparatus of FIG. 2.

Table 1 illustrates the change in the retaining force with position of the cam 49. The start position illustrates the initial upset force required to overcome the spring biasing which is adjustable as illustrated by the settings 1–8. The mid position indicates the reduction in force required to continue movement after the upset point is reached and the end position indicates the force available for retraction of the boot plates. With this type of adjustment, a fairly rigid binding is provided under normal loads, with abnormal loads allowing quick extension of the cables and release from the stable condition. A reduction in the load allows retraction of the boot plate to its pre-release position Referring to FIG. 4, the tensioning apparatus is shown in cross-section. The cam 49 has upper and lower portions 49*a* and 49*b*, and is driven by upper and lower rollers. The pulley 42 has three independently rotatable sections, 42*a*, 42*b* and 42*c*, to properly rotate during cable extension without binding. The cable 5 is wrapped around these sections and the sections of pulley 41 three times. Of course, the cable may be wrapped once, twice or more times around these pulleys. A spring guide plunger 56 biased by the spring 50 holds the cam 49 in contact with the rollers. A passage 57 in the screw 52 assures axial alignment of the plunger 56 and the cam 49.

In operation, the user sets his boots on the boot plates, with straps overlying the boots. The cable ends are attached to the front and rear parts of the boot attachment plates and the rider's boots are generally transverse to these plates. The user moves his body and shifts in the normal manner as the ride progresses. With normal forces applied, each boot plate 13 is held in a stable condition by tension forces applied from the cable ends attached the base plates 28.

Forces applied to the boot plates during the ride are transmitted to each of the cables 5, 6, each being wound around the pulley set of its respective tensioning mechanism 39, 40. This causes a pulley set to try to move on the face of cam 49 against the biasing force of its spring 54. As the pulleys rotate, they move closer to each other since each pulley shaft 45, 46 is in the slot 47. The cable unwinding from the pulley set as the pulleys move closer together extends outwardly to the boot plates, meaning that the plates 13 are no longer held in the stable condition (pulleys have not rotated) and they now can move relative to the bushings 16, 17. The boot plate movement is limited with the pulleys in the positions shown in FIG. 2 since the part of the cam face being engaged at this time is at a relatively shallow angle.

If the force applied is large enough to move the pulley set up along the cam face past the upset point 55, the pulleys encounter a steeper angle part of the cam face and move more quickly so that more cable is extended at a faster rate. This permits freer movement of the boot plates. As the force is reduced on the boot plates, by the rider encountering a more natural situation, the biasing force of spring 49 moves to separate the pulleys. This retracts the free cable which played off of the pulleys and rewinds it back onto the pulleys. Thus, the boot plates are placed back in the stable condition.

Each cable 5 and 6 interconnects 5 a portion of each of the two adaptor plates before being connected to the snowboard. Consequently, the motion in one plate will have an affect on the other plate. For example, raising of the laternal (outside) side portion of the boot plate 2, e.g., by the rider shifting his weight toward the rear of the board, will after the upset force point is reached cause the pulleys to be drawn together and thus reduce the rigidity of the forward portion of the second plate 3 a corresponding amount. Similarly, a motion which causes extension of the cable on plate 3, will cause an increase in flexibility of plate 2. Thus, an initial degree of movement is absorbed as the cable shifts from or affects movement of another plate and with proper adjustment of the retaining force, some plate movement can be allowed. When extreme force on either plate is encountered, i.e., above the upset forces the pulleys pass the cam breakaway point 55 which more rapidly extends the cable to one boot plate or to both boot plates.

Referring to Table 2, the options in extension in response to various forces are shown.

TABLE 2

| EXTENSION CHARACTERISTICS:* | |
|---|---|
| FORWARD - ONE FOOT | 80' MIN. |
| FORWARD - BOTH FEET | 40' MIN. |
| LATERAL - ONE FOOT | 40' |
| LATERAL - BOTH FEET | 20' |
| REARWARD - ONE FOOT | 60' MIN. |
| REARWARD - TWO FEET | 30' MIN. |
| TWIST - ONE FOOT | ±80' |
| TWIST - TWO FEET | ±40' |

*NOTE:
An extension at one foot will result in a reduction of the torque necessary to initiate an extension at the other foot. (See load characteristics table.)

Another advantage of the present invention is that failure or breakage of one cable will release both boot plates simultaneously, to prevent one boot from being trapped on the snowboard. Previous binding systems, which used separate, isolated boot bindings, could not provide this safeguard. Also, using independently adjustable tensioning devices, the tension can be reduced to a point when some movement of the boot plates can be accommodated by those practicing complex maneuvers, generally known as "hot dogging", or for other high performance applications.

While a particular embodiment of the present invention has been described including a double pulley tensioning apparatus, it will be understood by those skilled in the art that numerous other tensioning apparatus may be used with the present invention. Also, it will be understood by those skilled in the art that the cables may be attached to the sole plate in a number of positions up to and including normal to the longitudinal axis of the snowboard. While two cables are shown, it will be understood by those skilled in the art that a third cable could also be included which extends to a central point of the adaptor plates with the third cable being of an either strong or weaker tension from the other two cables and thus may act as a back-up cable should other problems arise with the primary and secondary cables.

Another variation contemplated includes the use of a single cable, disposed between the center points of the boot plates. Also, the cable ends may be attached to the boot plates rather than to the snowboard, with the cables passing upward through the guide bushings rather than downward as illustrated. Another variation within the scope of the invention is the attachment of one end of each cable to a snowboard and the other end of each cable to a boot attachment assembly, and of course, numerous other cam types and cam surface shapes could be used.

We claim:

1. A snowboard binding system comprising:

a first boot attachment means, and a second boot attachment means, each boot attachment means disposed for movement on a snowboard in response to forces applied by the snowboard rider;

a first cable attached to each of said first and second boot attachment means;

and a first tensioning means acting on said first cable, said first tensioning means normally biasing the first cable into a first retracted condition providing a retaining force holding the first and second boot attachment means in a stable condition on the snowboard, said first tensioning means responding to loads applied by the rider above a first predetermined level to overcome the normal biasing of said first cable to extend the cable length to a more lengthened condition and reducing the retaining force for at least one of said boot attachment means to permit movement thereof relative to but without detachment from the snowboard.

2. The snowboard binding system of claim 1, wherein the first boot attachment means comprises a base plate mounted to a snowboard, an adaptor plate disposable on the base plate and a boot plate mounted on the adaptor plate.

3. The snowboard binding system of claim 1, wherein the second boot attachment means comprises a base plate mounted to a snowboard, an adaptor plate disposable on the base plate and a boot plate mounted on the adaptor plate.

4. The snowboard binding system of claim 1, wherein a said boot attachment means comprises a base plate mounted to a snowboard and a unitary adaptor plate mounted for movement with respect to the base plate.

5. The snowboard binding system of claim 1, wherein each boot attachment means includes a plurality of resilient supporting pads disposed about a periphery thereof, a boot attachment means moving with respect to said pads when released from the stable condition.

6. The snowboard binding system of claim 1, wherein the first boot attachment means is located forwardly on a snowboard and is disposed at an angle relative to a longitudinal axis of the snowboard.

7. The snowboard binding system of claim 1, wherein the second boot attachment means is located rearwardly on the snowboard and disposed normal to the longitudinal axis of the snowboard.

8. The snowboard binding system of claim 1, wherein the pair of cables are attached to the boot attachment means in positions normal to a boot placed thereon.

9. The snowboard binding system of claim 1 further comprising a second cable attached to each of said first and second boot attachment means and a second tensioning means acting on said second cable independently of said first cable and said first tensioning means for normally biasing the second cable into a first retracted condition providing a retaining force holding the first and second boot attachment means in a stable condition on the snowboard, said second tensioning means responding to loads applied by the rider above a first predetermined level to overcome the normal biasing of said second cable to extend the cable length to a more lengthened condition and reducing the retaining force for at least one of aid boot attachment means to permit movement thereof relative to but without detachment for the snowboard.

10. The snowboard binding system of claim 9, wherein one cable connects a forward portion of the first boot attachment means to a forward portion of the second boot attachment means.

11. The snowboard binding system of claim 10, wherein the other cable connects a rearward portion of the first boot attachment means to a rearward portion of the second boot attachment means.

12. The snowboard binding system of claim 7, wherein the first tensioning means comprises a pair of opposed pulleys abut which the first cable is wound, each pulley rotatably supported on a shaft, a frame having a pair of facing slots, within which the pulleys are mounted, each shaft disposed within one of the facing slots, biasing means provided for urging the pulleys away from each other such that a force overcoming the force of the biasing means causes the pulleys to move into closer proximity with each other.

13. The snowboard binding system of claim 12, wherein the biasing means further comprises a cam and a spring for urging the cam into contact with rollers disposed on the pulleys, the rollers being rotatable with the pulleys, the spring biasing the cam such that the rollers maintain the pulleys in their maximum separated position.

14. The snowboard binding system of claim 13, wherein the cam has an angled surface on at least one face thereof engaging a roller for changing the retaining force with a change in pulley position.

15. The snowboard system of claim 14 wherein said at least one cam face has two different angled surfaces each to provide a different rate of change of the retaining force.

16. The snowboard binding system of claim 9, wherein the second tensioning means is identical to the first tensioning means.

17. The snowboard binding system of claim 9, wherein the biasing of each tensioning means is independently adjustable by separate adjustment means.

18. A snowboard binding system comprising at least one boot attachment means mounted for movement on a snowboard, said boot attachment means for fixedly holding a boot thereon; cable means attached to the boot attachment means at a location generally normal to the length of a boot to be placed thereon; and means fixedly connected to the cable means for providing a force for retaining the boot attachment means to the snowboard and responsive to external forces acting on the boot attachment means such that under force loads below a first predetermined level acting on said boot attachment means the boot attachment means is retained fixed on the snowboard and under force loads at or above said predetermined first level the boot attachment means is only conditionally partially releasable so as to be responsive to further force above said first predetermined level for movement with respect to the snowboard and remains attached to the snowboard with the boot attached thereto.

19. A snowboard binding system comprising first and second movable boot attachment means each to accept the boot of a rider mounted in a spaced relationship onto the snowboard, a cable attached to each of said first and second boot attachment means, variable tensioning means coupled to said cable, said tensioning means holding said cable in a retracted condition by providing a retaining force to said cable in response to a predetermined force load condition on both of the boot attachment means to hold both said boot attachment means in a stable condition, and responsive to forces in excess of said predetermined force load to extend the cable length and thereby reduce the retaining force on at least one of said boot attachment means to permit motion thereof without detachment from the snowboard.

20. A snowboard binding system as in claim 19 wherein said variable tensioning means acts on said cable such that when the cable extends one boot attachment means has less retaining force applied thereto and the other has more.

21. A snowboard binding system as in claim 19 wherein said variable tension means acts to provide a cable extension at a first rate in response to abnormal force loads at and about said predetermined force load and below a first level of greater force load.

22. A snowboard binding system as in claim 21 wherein said variable tension means acts to provide a rate of cable extension faster than said first rate in response to force loads greater than said first level.

* * * * *